US006692383B1

(12) United States Patent
Heron

(10) Patent No.: US 6,692,383 B1
(45) Date of Patent: Feb. 17, 2004

(54) PRECISION GOLF TEE

(76) Inventor: William T. Heron, 9342 Athens Rd., Fairfax, VA (US) 22032

( * ) Notice: Subject to any disclaimer, the term of this patent is extended or adjusted under 35 U.S.C. 154(b) by 44 days.

(21) Appl. No.: 10/096,800

(22) Filed: Mar. 14, 2002

Related U.S. Application Data

(60) Provisional application No. 60/294,216, filed on May 31, 2001.

(51) Int. Cl.[7] ..... A63B 57/00
(52) U.S. Cl. ..... 473/400; 473/398
(58) Field of Search ..... 473/387–403; D21/717, 718

(56) References Cited

U.S. PATENT DOCUMENTS

| | | | | | |
|---|---|---|---|---|---|
| 1,553,561 | A | * | 9/1925 | Scott | 473/400 |
| 1,736,583 | A | * | 11/1929 | Deike | 473/396 |
| 1,981,810 | A | * | 11/1934 | Parkhurst | 473/402 |
| 2,456,511 | A | | 12/1948 | Isserstedt | |
| 2,589,763 | A | | 3/1952 | Barrett | |
| 2,747,768 | A | | 5/1956 | Raines | |
| D210,837 | S | | 4/1968 | Warner | |
| 5,372,362 | A | * | 12/1994 | Barker | 473/391 |
| 6,186,907 | B1 | * | 2/2001 | Woodward | 473/400 |

* cited by examiner

*Primary Examiner*—Steven Wong

(57) ABSTRACT

A kit for constructing a golf tee having a shaft and a plurality of bodies that can be assembled onto the shaft.

10 Claims, 1 Drawing Sheet

PRECISION GOLF TEE

Applicant claims the priority of U.S. Provisional application Ser. No. 60/294,216, filed May 31, 2001.

BACKGROUND OF THE INVENTION

This invention relates, in general, to a precision golf tee and, in particular, to a golf tee which has a positive stop adapted to hold a ball at a predetermined height which can be varied but which is always precisely known.

Traditionally when "teeing off" in the sport of golf, the golf ball is placed upon a wooden or plastic device known as a tee. Tees are designed to hold the ball up off the ground so that the golfer can get maximum distance and/or elevation out of his or her first swing. Golfers vary in their preference as to how high off the ground the ball should be when teeing off. Also, different conditions call for different tee heights. Placing a ball higher off the ground and putting a back spin on the ball will cause the ball to stop dead when it lands, while placing the ball low and topping it will result in much longer drives with a lot of forward roll after the ball lands. The high or low placement of the ball is normally achieved by how far the tee is pushed into the ground.

There is a problem with this because the golfer may misjudge how far the tee is in the ground and top the ball when he meant to drive it or waste the energy of his or her swing by hitting the ground during the swing. Difficulty in judging the height of the tee-supported ball may be caused by the height of the grass, which can vary from one area to another on the same golf course, or by lack of experience.

Numerous attempts have been made to design tees that can hold the ball at different heights, but to date none has been provided with a positive stop to measure the distance above the ground together with an anchoring pin which will hold the ball at the selected height against the upward thrust of the grass.

The present invention allows a golfer to custom build a tee for any situation. And, the tee, when constructed, will exactly position a ball relative to the ground regardless of the height of the grass. By positively positioning the ball at a particular height, selected by the golfer for a particular situation, the golfer may get a more precise and uniform drive.

DESCRIPTION OF THE PRIOR ART

In the prior art various types of tees have been proposed. For example, U.S. Pat. No. 2,456,511 to Isserstedt shows golf tees which may be nested together.

U.S. Pat. No. 2,589,763 to Barrett shows golf tees in which a top part may be nested together with a bottom part to provide tees having different elevations. The FIG. 7 species of Barrett shows a ball support having a generally flat bottom and conical recess; however since this tee is continuously tapered and adapted to fit inside the conventional height tee shown in Barrett's FIG. 6, the spike portion of Barrett's tee does not have sufficient holding power to hold the disc 17 against the upward thrust of the grass.

U.S. Pat. No. 2,747,768 to Raines shows golf tees which may be used individually or nested together with other tees to form ball supports which provide tees having different elevations.

U.S. Des. Pat. No. 210,837 to Warner shows golf tees having a square shaft.

SUMMARY OF THE INVENTION

The present invention is directed to golf tees which will improve a golfer's initial hit off the tee.

It is an object of the present invention to provide a new and improved golf tee which has a positive stop so that the distance between the top and bottom surfaces of the tee and thus the resulting height of the ball off the ground is precisely measured.

It is a further object of my invention to provide a tee where the length of the stem or pin may be varied to hold the ball at the selected height against the upward force of the grass. The present invention provides a longer stem or pin in loose or wet soil and a short stem for hard soil.

It is a further object of the present invention to provide a new and improved golf tee which can be manufactured to specifications by a golfer to set the height of the ball above the ground to the golfer's specifications.

It is a further object of the present invention to provide a new and improved golf tee which will allow the golfer to know the real height of his ball above the ground surface regardless of the height of the grass.

It is a further object of the invention to provide a golf tee which may be made of wood or plastic and is designed to carry clearly legible indicia or advertisements on the outer surface.

These and other objects and advantages of the present invention will be fully apparent from the following description, when taken in connection with the annexed drawings.

DESCRIPTION OF THE PREFERRED EMBODIMENT

Figure 2A:
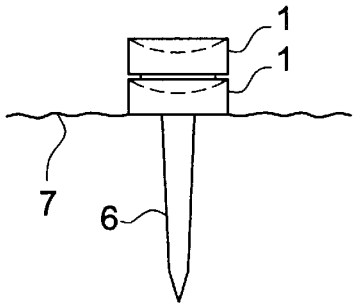
FIGS. 2A, 2B and 2C show combination tees of various heights in accordance with this invention.
Figure 2B:
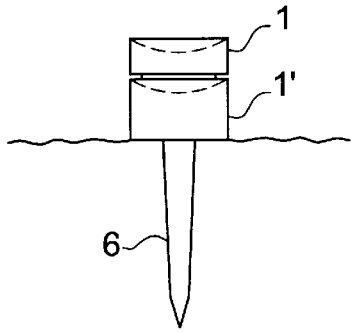
Figure 2C:
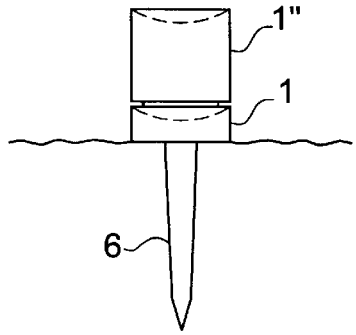
Figure 3:
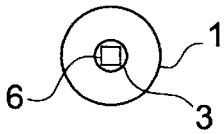
FIG. 3 is a top view of the present invention.

Referring now to the drawings in greater detail, FIG. 1 shows a tee in accordance with this invention. This tee has a body 1 with a spherical or conical ball-receiving recess 2 and a flat lower surface 5. A generally cylindrical opening or hole 3 (see FIG. 3) passes through the body 1. A square pin 6 having a point 11 and a generally non-tapering cross section frictionally engages the sidewalls of the cylindrical opening or hole 3 and penetrates a distance into the ground sufficient to hold the lower surface 5 in contact with the ground against the upward thrust of the grass, even when this tee has been combined with one additional body 1, as shown in FIG. 2A, or combined with the additional bodies 1', as shown in FIG. 2B, or with the additional body 1" as shown in FIG. 2C.

Pin lengths between 1 and 2 inches have been found, together with the non-tapering cross section, to provide enough frictional contact with the soil to prevent the blades of grass from altering the elevation of the ball. Longer shanks or pins 6 are required for soft or wet soil and shorter pins may be used in harder ground.

Figure 1A:
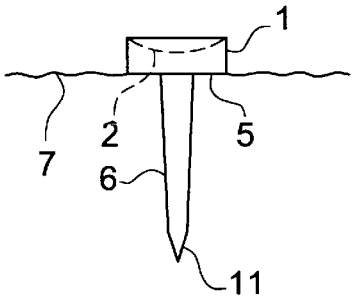
FIGS. 1A, 1B and 1C are side views of tees in accordance with present invention having different elevations.

In FIG. 1A the distance between the flat bottom surface 5 and the cylindrical or conical recess 2 is known due to the dimension of the height of the body 1. In use the golfer will press the tee into the ground until the flat bottom 5 engages the ground 7. At this point the golfer knows what distance his/her ball is from the ground surface 7.

It should be noted that tees in accordance with this invention have a generally cylindrical outer surface which may be printed, molded or engraved with indicia or advertising. This is important because tees are often given out as promotional items and this generally cylindrical surface provides an ideal location for promotional material.

Figure 1B:
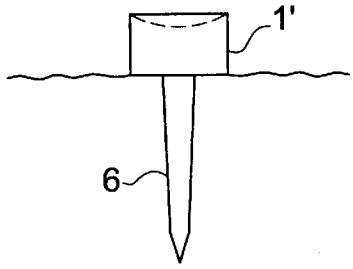
Figure 1C:
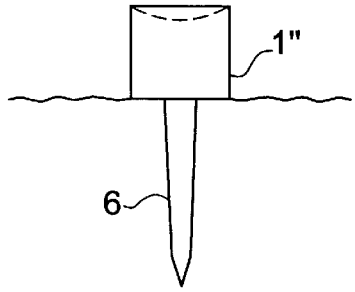

FIGS. 1B and 1C show alternative tees which are identical to the tee of FIG. 1A, in which the height of the body 1 is approximately ¼ inch, except that the height of the body 1', in FIG. 1B, is approximately ⅜ inch and the height of the body 1", in FIG. 1C, is approximately ⅝ inch.

It should be noted that the basic units shown in FIGS. 1A, 1B, and 1C when combined with a plurality of bodies 1, 1', 1" can be used to build tees of virtually any height as shown in the combination tees of FIGS. 2A, 2B and 2C.

As shown in FIG. 2A, a pair of bodies 1, each of which are ¼ inch are provided on the shaft 6. As shown in FIG. 2B, a pair of bodies 1 and 1', with the body 1 being ¼ inch and the body 1' being ⅜ inch are provided on the same shaft 6. As shown in FIG. 2C, a pair of bodies 1 and 1", with the body 1 being ¼ inch and the body 1' being ⅝ inch are provided on the same shaft 6. By using different height tees, a golfer can construct a special tee for any conditions, as the situation requires. Also, it should be noted that FIGS. 2A–2C are provided merely examples of the different combinations that can be constructed, and other combinations, such as two bodies 1" can be provided on the same shaft 6. Also, while the diameters of the bodies are show as the same, these may vary without departing from the scope of the invention.

The preferred embodiment body 1 has been shown having round openings or holes 3 and square shanks on pins 6 force fitted into the body 1. These pins and bodies may be formed from biodegradable wood or molded from brightly colored plastic. Metal is also a possibility, but this material is generally frowned upon by grounds keepers since metal pins can damage reel-type lawn mowers.

In the preferred embodiment the body 1, in FIG. 1A, is identical with the bodies 1', 1" shown in FIGS. 1B, 1C, except for height.

The present invention shows a flat lower surface 5 but it is to be understood that the lower surface could be radially saw-toothed or corrugated to prevent grass or other tiny objects on the ground from changing the measured elevation. Alternatively, since the shaft 6 is made separately from the main body then both the upper and lower surfaces may have a spherical or conical recess. The important fact is that a relatively planar surface is defined on the lower face of the tee to make contact with the soil and produce a platform having a positively measured height for the ball.

Also, a plurality of various bodies 1, 1', 1", and shafts 6 can be provided in kit form so the golfer can construct virtually any tee for any circumstance.

Figure 4:
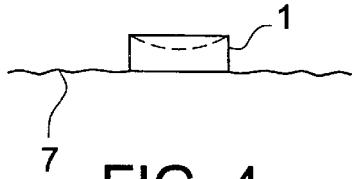
FIG. 4 is a side view showing another use of the invention.

FIG. 4 shows another use of one of the items of the kit of the present invention. This would probably be used only by expert golfers. It is well known if a golf club strikes the shaft of the tee as well as the ball, the golf ball could be hit off line. For example, if a golfer hits the ball and at the same time hits the shaft of the tee, and if the club face is slightly off line when it hits, the resistance of the shaft of the tee could cause the golf ball to be hit off line. This is caused by the resistance of the shaft which will turn the club face slightly if the club face does not strike the ball perfectly.

In order to prevent this from happening, the body 1 of the present invention could be placed on the ground, as shown in FIG. 4, without the shaft 6, then the ball is placed on the body member 1 in the usual manner. Next, the user would hit the ball normally. Since no shaft is used, there is no chance that the club hitting the shaft will sent the ball off line.

Although the precision golf tee and the method of using the same according to the present invention has been described in the foregoing specification with considerable details, it is to be understood that modifications may be made to the invention which do not exceed the scope of the appended claims, and modified forms of the present invention done by others skilled in the art to which the invention pertains will be considered infringements of this invention when those modified forms fall within the claimed scope of this invention.

What I claim as my invention is:

1. A kit for constructing a custom golf tee, said kit comprising:

at least one shaft, said shaft having a first end adapted to receive at least one body, and a second end adapted to be inserted into a supporting surface, said first end of said shaft having a cross-sectional shape, said kit also comprising a plurality of bodies, said plurality of bodies having a top surface, a bottom surface and sides connecting said top and bottom surfaces, and a height, some of said plurality of bodies having different heights than others of said plurality of bodies, each of said plurality of bodies having means for receiving said first end of said shaft, and wherein said means for receiving said first end of said shaft is an aperture having a cross-sectional shape, and wherein said cross-sectional shape of said aperture is different than said cross-sectional shape of said first end of said shaft.

2. A custom golf tee, said custom golf tee comprising:

a shaft, said shaft having a first end adapted to receive at least one body, and a second end adapted to be inserted into a supporting surface, said first end of said shaft having a cross-sectional shape, at least one body, said body having a top surface, a bottom surface and sides connecting said top and bottom surfaces, and a height, said body having means for detachably receiving said first end of said shaft, and wherein there are a plurality of bodies assembled on said shaft.

3. The kit as claimed in claim 1, wherein there is a frictional engagement between said at least one shaft and means for receiving said first end of said shaft.

4. The kit as claimed in claim 1, wherein said top surface of said plurality of bodies have a depression thereon.

5. The custom golf tee as claimed in claim 2, wherein said means for receiving said first end of said shaft is an aperture having a cross-sectional shape.

6. The custom golf tee as claimed in claim 5, wherein said cross-sectional shape of said aperture is different than said cross-sectional shape of said first end of said shaft.

7. The custom golf tee as claimed in claim 2, wherein there is a frictional engagement between said shaft and said means for receiving said first end of said shaft.

8. The custom golf tee as claimed in claim 2, wherein said top surface of said body has a depression thereon.

9. The custom golf tee as claimed in claim 2, wherein at least one of said plurality of bodies has a different height than at least one other of said plurality of bodies.

10. The custom golf tee as claimed in claim 1, wherein said cross-sectional shape of said aperture is circular and said cross-sectional shape of said first end of said shaft is rectangular.

* * * * *